US007201638B2

(12) United States Patent
Manning et al.

(10) Patent No.: US 7,201,638 B2
(45) Date of Patent: Apr. 10, 2007

(54) ENVIRONMENTAL CONTROL SYSTEM FOR A CENTRIFUGAL PROCESSOR

(75) Inventors: Daniel Manning, Clifton, NJ (US); Craig Bredeson, Eatontown, NJ (US); Robert Bringard, Wilmington, NC (US)

(73) Assignee: Mikronite Technologies Group, Inc., Eatontown, NJ (US)

( * ) Notice: Subject to any disclaimer, the term of this patent is extended or adjusted under 35 U.S.C. 154(b) by 0 days.

(21) Appl. No.: 11/209,514

(22) Filed: Aug. 23, 2005

(65) Prior Publication Data

US 2007/0049165 A1 Mar. 1, 2007

(51) Int. Cl.
*B24B 31/033* (2006.01)

(52) U.S. Cl. ..... 451/36; 451/327

(58) Field of Classification Search ..... 451/32, 451/36, 33, 34, 35, 326, 327, 328, 329
See application file for complete search history.

(56) References Cited

U.S. PATENT DOCUMENTS

| | | | | |
|---|---|---|---|---|
| 347,981 | A * | 8/1886 | Albee | 451/33 |
| 3,333,367 | A * | 8/1967 | Salvaire | 451/328 |
| 3,503,157 | A * | 3/1970 | Harper | 451/329 |
| 3,579,920 | A * | 5/1971 | Heiberger | 451/329 |
| 4,041,648 | A * | 8/1977 | Heiberger | 451/329 |
| 5,355,638 | A | 10/1994 | Hoffman | |
| 5,476,415 | A * | 12/1995 | Nishimura et al. | 451/326 |
| 5,672,094 | A * | 9/1997 | Nishimura et al. | 451/32 |
| 5,848,929 | A | 12/1998 | Hoffman | |
| 6,599,176 | B2 | 7/2003 | Hoffman | |
| 6,733,375 | B2 | 5/2004 | Hoffman | |
| 6,758,729 | B2 * | 7/2004 | Fujishiro | 451/328 |
| 6,863,207 | B2 | 3/2005 | Hoffman | |

FOREIGN PATENT DOCUMENTS

WO PCT/US03/21218 7/2003

OTHER PUBLICATIONS www.exair.com/vortextube/vt-page.htm, 1 page (undated by acknowledged, prior to filing date) as existing.

* cited by examiner

*Primary Examiner*—Robert A. Rose
(74) *Attorney, Agent, or Firm*—Drinker Biddle & Reath LLP

(57) ABSTRACT

A centrifugal processor is disclosed with includes an outer frame having an inner surface and an axis. At least one inner vessel positioned within the outer frame and is adapted to receive an object to be processed. A drive system rotate the inner vessel with respect to the outer frame and along the inner surface of the outer frame. The drive system includes a central shaft engaged with the vessel for rotating the vessel about the axis. An environmental control system is included which channels a secondary medium to or from the vessel to assist in the processing of the object. The environmental control system includes a manifold formed in at least a portion of the central shaft and adapted to channel the secondary medium. At least one port is formed in the central shaft and connected to the manifold. A conduit connects the port and the inner vessel for channeling the secondary medium between the manifold and the interior of the vessel.

9 Claims, 3 Drawing Sheets

ENVIRONMENTAL CONTROL SYSTEM FOR A CENTRIFUGAL PROCESSOR

FIELD OF THE INVENTION

The present invention relates to a system for controlling the processing environment within a vessel being subjected to centrifugal processing.

BACKGROUND OF THE INVENTION

Advances in the field of high speed material processing have created new and improved uses for surface finishing. Examples of high speed processors which have recently proved successful in the industry are available from Mikronite Technologies, Inc., and are disclosed in U.S. Pat. Nos. 5,355,638, 5,848,929, 6,599,176, 6,733,375 and PCT/JUS03/21218, which are all incorporated herein by reference in their entirety. The centrifugal finishers disclosed in those patents include an outer vessel or housing and at least one, and in many cases several, inner vessels located within the outer vessel. The inner vessels are revolved around the inside surface of the outer vessel while concomitantly rotating about their own axes. A traction surface is preferably included between the inside surface of the outer vessel and the outside surface of the inner vessel. The traction surface provides a frictional interface that assists in rotation or rolling of the inner vessel along the surface of the outer vessel, while the inner vessel experiences centrifugal forces. The forces, in turn, are transferred to finishing media located within the inner vessel, thereby providing high speed polishing of the products contained in the inner vessel. As described herein, the terms polishing and finishing are intended to cover not only fine removal of surface particles, but also coarse removal of material which is more akin to a sanding operation. Thus, the term is intended to cover altering the surface of an article.

The speeds at which these devices operate are extremely high. In particular, the media within the vessels in these machines experience consistent accelerations in excess of 16 g's, and can be as high as above 120 g's. These high speeds are very beneficial in a finishing process since they permit the finishing media to perform efficient finishing of the entire surface area.

As discussed in U.S. Pat. No. 6,863,207, which is incorporated herein by reference in its entirety, the higher speeds and accelerations that can be obtained with these systems open up the use of surface finishing to other material processing operations. In particular, U.S. Pat. No. 6,863,207 describes how current welding operations can be improved with the use of high speed centrifugal processing. The patent specifically describes how the creation of a vacuum within the processing vessel can assist in welding of materials. In one example, cobalt malt is mixed with tungsten carbide to make inserts for tools. Currently, this combination can only be achieved when subjected to high temperatures and high pressure.

While U.S. Pat. No. 6,863,207 discloses a system for generating a vacuum inside a vessel during a rotational processing procedure, further benefits can be provided by controlling the environment within the vessel. For example, in a centrifugal tumbling/polishing system, high energy is imparted in a cascading motion to produce controlled friction, resulting in abrading and surface refinement as well as sub-surface compression. During the processing, considerable heat is developed. Such heat may not be desirable during the processing, or in certain cases, it may be desirable to increase and/or focus the heat energy during the processing. In addition it may be desirable to introduce a gas or complex atmosphere in order to accelerate a chemical reaction or form a coating on the article. Thus, further processing benefits can be achieved if the environment within a processing vessel can be controlled.

SUMMARY OF THE INVENTION

The present invention relates to a environmental control system for use with a high speed centrifugal or rotational processing machine. The centrifugal or rotational processing machine includes an outer vessel or frame structure with an inner surface. At least one inner vessel is positioned within the outer frame structure and adapted to receive at least articles and processing media. The processing machine also includes a drive system which causes the inner vessel to rotate with respect to the outer frame and roll along the inner surface of the frame.

The environmental control system is designed to supply a secondary medium into the vessel to assist in the processing of the articles. The secondary medium either a reactant or a buffer may be a solid, liquid and/or gas that is pumped or injected into the vessel prior to, during or after rotation. In one exemplary embodiment, the medium is a cooled gas, such as chilled air, that is supplied into the vessel to reduce the temperature of the interior of the vessel, as well as the articles and/or abrasive media.

The foregoing and other features and advantages of the present invention will become more apparent in light of the following detailed description of the preferred embodiments thereof, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DESCRIPTION OF THE PREFERRED EMBODIMENTS

Figure 1:
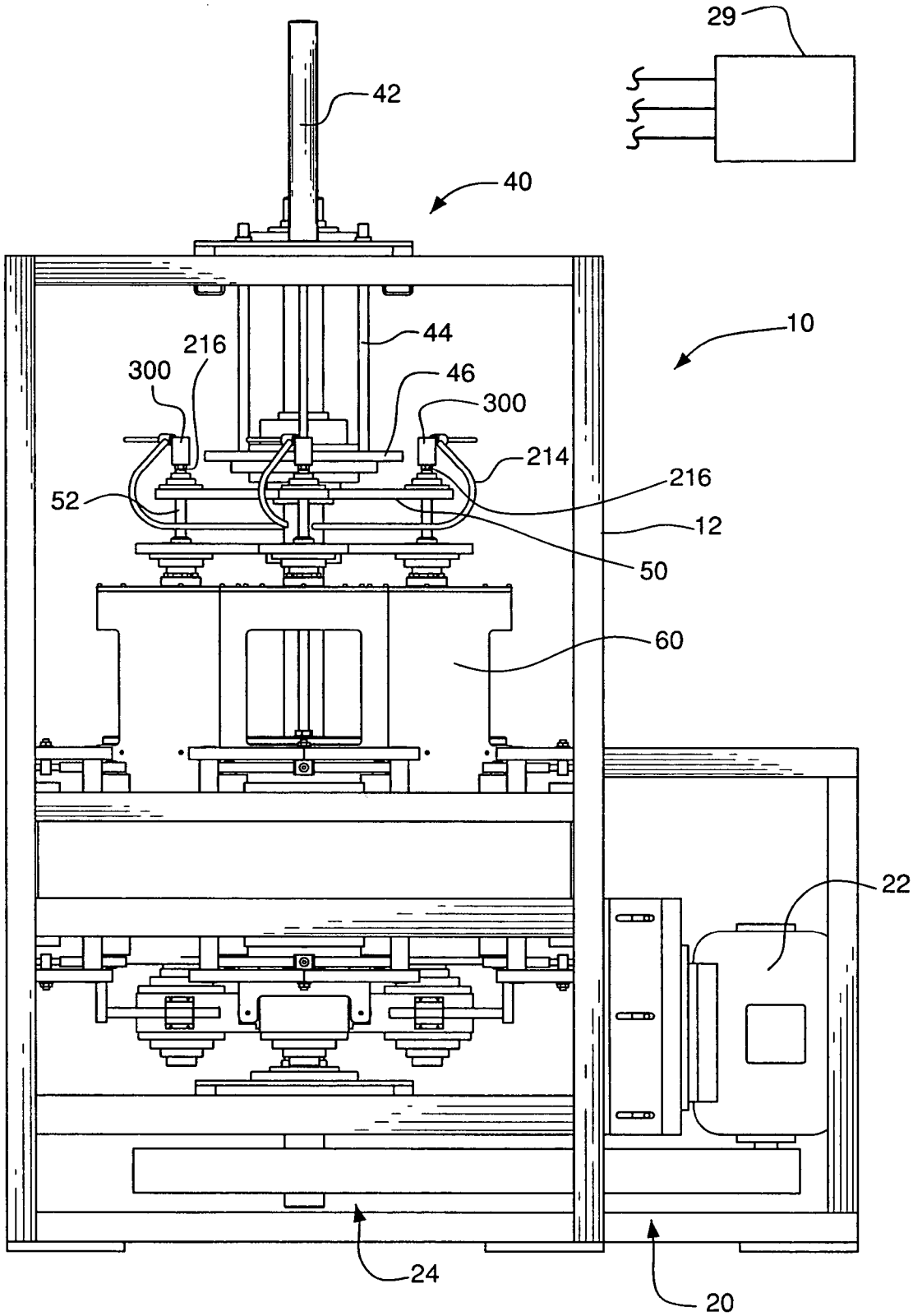
FIG. 1 is a front section view of a centrifugal processor for use with an environmental control system according to the present invention.
Figure 2:
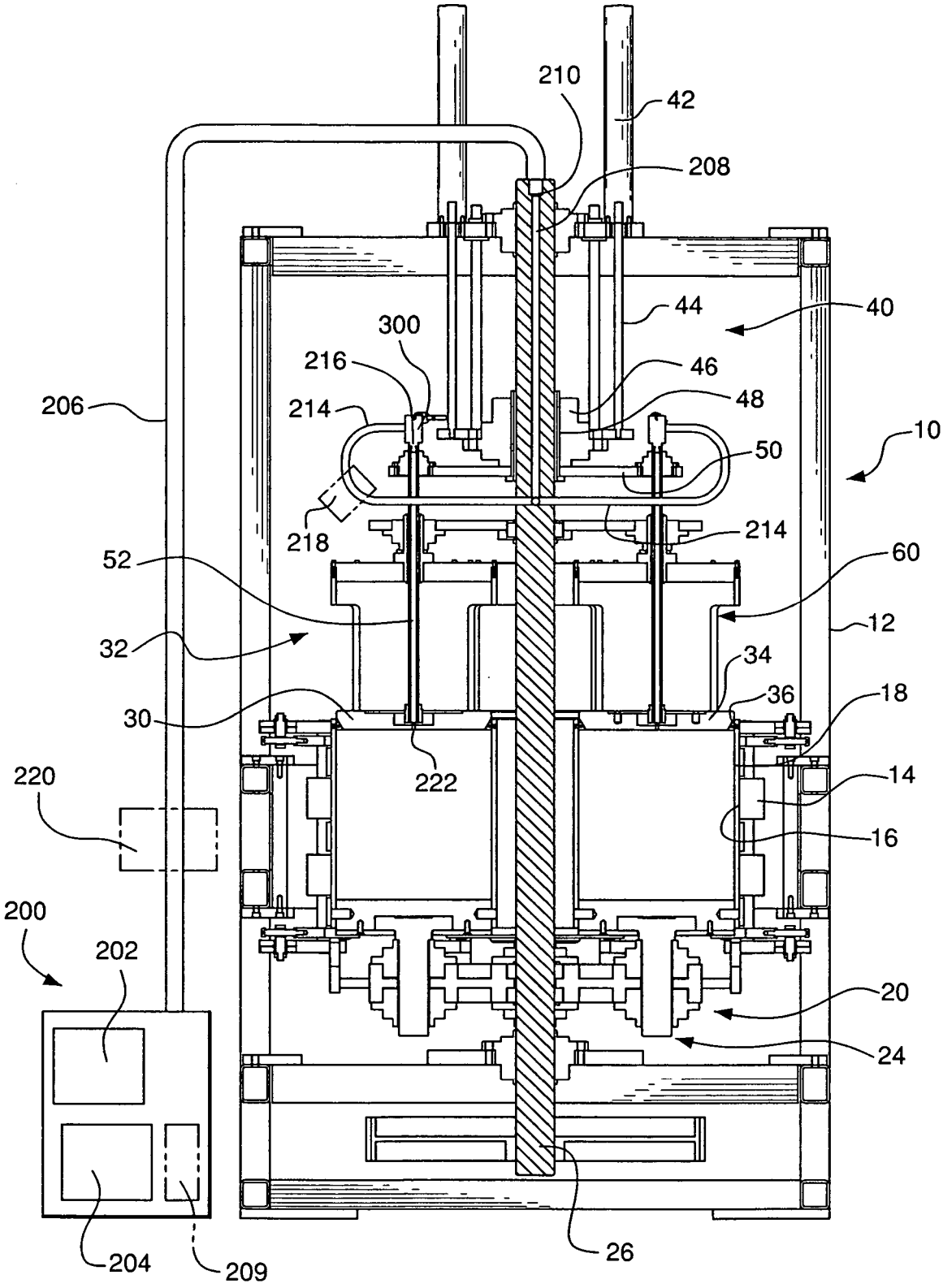
FIG. 2 is a partial cross-sectional view of the centrifugal processor of FIG. 1 illustrating schematically the environmental control system according to one exemplary embodiment of the present invention.

Referring now to the drawings, wherein like reference numerals illustrate corresponding or similar elements throughout the several views, FIGS. 1 and 2 are side cross-sectional views of one embodiment of the high speed centrifugal apparatus 10 which may be used as part of the present invention. The apparatus in this embodiment of the invention is similar to the device disclosed in U.S. Pat. No. 5,355,638, which has been incorporated herein by reference in its entirety, and, therefore, a detailed discussion of the components of the assembly is not provided in this specification. Those skilled in the art would readily understand and appreciate the various structural configurations of a centrifugal processor that can be used with the present invention. As such, only a general discussion of the illustrated assembly is provided herein.

The apparatus 10 in FIGS. 1 and 2 includes a housing or support frame 12 which encloses and/or supports an outer frame 14 in a conventional manner. As discussed in the above referenced patents, the outer frame 14 may be mounted so that it is rotatable within the support frame 12. However, in the illustrated embodiment, the outer frame 14 is fixed to the support frame 12 and/or the ground. The outer frame 14 includes an inner surface 16 which is preferably cylindrical in shape.

One or more inner vessels or containers 18 are adapted to be placed within the outer frame 14. Each inner vessel 18 is adapted to contain objects to be subjected to finishing process. As shown in FIG. 2, the inner vessel 18 is engaged to a drive system 20 which includes a motor 22 and a transmission system 24. In the illustrated embodiment, the transmission system 24 includes a plurality of gears or pulleys. Any conventional motor 20 and suitable gearing or transmission arrangement can be used in the present invention.

As discussed in the above-referenced patents, the inner vessel 18 may include one or more subcomponent vessels, such as an outer sleeve and an inner processing container that slides into the outer sleeve. This arrangement permits the inner processing container (including the objects being processed) to be easily removed and replaced. A traction surface is preferably included between the inner vessel 18 and the inner surface 16 of the outer frame 14. The traction surface is described in detail in the related patents and, thus, no further discussion is needed. Preferably the traction surface is mounted to an outside surface on the inner vessel 18, and is made from a elastic material, such as urethane.

In the illustrated embodiment, the apparatus is shown with four inner vessels mounted to a common drive shaft 26. The drive shaft 26 is engaged with the transmission system 24 so as to be rotatably driven by the motor 22. The drive shaft 26 is adapted to rotate the inner vessels 18 around the inside surface 16 of the outer frame 14 (which happens to be around the outer frame's central axis when the outer frame is cylindrical as shown in the figures.) As discussed in more detail in U.S. Pat. No. 5,355,638, the mounting of each inner vessel 18 to the drive shaft 26 is configured so as to permit each inner vessel 18 to rotate about its own central axis while concomitantly being driven around (i.e., rolling along) the inner surface 16 of the outer frame 14. Thus, the components within the vessels are subjected to centrifugal as well as rotational forces.

A lid 30 is provided that is designed to mate with the open top of the vessels 18. The lid 30 is removably engaged with the inner vessel 18 so as to permit access to the contents within the inner vessel 18. Preferably, the lids 30 are part of a lid assembly 32 which provides controlled opening of the vessels 18. However, it is also contemplated that the lids 30 may be individually attached to the vessels 18 using any conventional attachment mechanism, such as clamps or bolts. The lids 30 are mounted so as to provide an enclosed environment within the container, preferably through a substantially airtight seal. As will be discussed in more detail below, the lid minimizes the ability of the contents within the container escaping during operation and allows for the creation and control of the environment within the vessel.

Each lid 30 includes a cover plate 34 preferably with a substantially conical sealing surface 36. The conical taper of the surface 36 assists in providing a good seal between the vessel 18 and the lid 30. The conical surface 36 is preferably made from a resilient material, such as an elastomer (e.g., rubber), urethane or foam, although other types of seal material may be used. It has been found that the use of a softer rubber, such as 70 durometer versus 95 durometer, works well at providing a tight seal.

Each lid 30 is attached to a lift system 40. The lift system 40 includes one or more actuators 42, such as pneumatic or hydraulic linear drives. The actuators 42 are mounted to the support frame 12, preferably above the inner vessels 18. The actuators 42 include linear shafts 44 that connect to a lift block 46. The lift block 46 is disposed about the drive shaft 26 such that the drive shaft rotates relative to the fixed lift block 46. A bearing sleeve 48 may be mounted between the lift block 46 and the drive shaft 26 so as to permit unrestricted rotation of the drive shaft 26.

The lift block 46 is engaged to a lift plate 50, such that the lift block 46 can translate the lift plate 50 vertically, but that the lift plate 50 is free to rotate relative to the lift block 46. In the illustrated embodiment, the engagement is provided through the bearing sleeve 48 that includes a lower flange on which the lift plate rests. Of course, other mounting arrangements can be used, including roller bearings.

A lift shaft 52 is attached to the plate and connects to an associated lid 30. Of course, if there are multiple lids 30, there would be a lift shaft 52 associated with each lid 30. The attachment of the lift shaft 52 to the lift plate 50 is designed such that the lift plate 50 and lift shaft 52 rotate in combination about the drive shaft 26. The lower end of the lift shaft 52 is secured to the lid 30 such that the lid 30 can rotate relative to lid shaft 52. Those skilled in the art would be readily capable of selecting a suitable connection device.

A lid frame 60 may be included in the lid assembly 32 to assist in providing planar movement of the lids 30 as they translate in the vertical direction.

During operation, if the lid assembly 32 is actuated to raise the lids, the actuators 42 raise the lift block vertically which, in turn, raises the bearing sleeve 48. The bearing sleeve 48 translates the lift plate 50 and lift shafts 52, thereby raising the lids 30.

A controller 29, such as a signal processor, electronic or digital controller or other type of control system, is used to control the operation of the motor and/or control the engagement, shifting or disengagement of the transmission. Such controllers are well known to those skilled in the art and, therefore, no further discussion is needed. The same controller 29 (or a separate controller) may be used to control the lid assembly 32.

Referring to FIG. 2, a schematic illustration of one exemplary embodiment of an environmental control system 200 is shown. The environmental control system 200 is designed to supply a secondary medium to the processing vessels 18 before, during and/or after centrifugal processing. The medium may be a gas, liquid, solid, or any combination thereof, which improves, modifies, supplements and/or changes the abrasive processing occurring within the vessel 18. For example, in one embodiment, the secondary medium is air (either ambient or compressed air) that is supplied to the vessel 18 to assist in cooling the abrasive media within the vessel 18 during or after processing. As will be discussed in more detail below, the air may be cooled prior to being supplied into vessel 18. The gas may, alternately, be a gas that supplements the processing. For example, as discussed in U.S. Pat. No. 6,863,207, argon or hydrogen gas can be introduced during processing into the processing vessel to inhibit oxidation. The medium may be a liquid, such as a lubricating oil, designed to coat the processed parts before they are removed from the vessel, thereby inhibiting or reducing corrosion or oxidation during shipment or in storage. It is also contemplated that the supplied medium may be a solid, such as a secondary abrasive, that is designed to augment the processing step. For example, it may be desirable in certain cases to use a certain abrasive that happens to break down relatively quickly. The environmental control system permits additional abrasive to be added to the system during processing without stopping the machine.

It should also be noted that the supply of gas is not limited to cooling or affecting the finishing process. Instead (or in addition), the gas may be supplied to help exhaust dust and other small particulate from around the articles during processing. The gas may also be supplied to heat the work piece to either effect the surface finishing or as a precursor to a subsequent processing step.

The environmental control system 200 includes a supply or reservoir 202 which contains or provides the secondary medium to be channeled into the vessels 18. The environmental control system 200 may include a temperature control system, such as a refrigeration or heating unit 204 which is used to cool or heat the secondary medium depending on the conditions desired. A conduit 206 preferably connects the supply 202 to a manifold 208. In the illustrated embodiment, the manifold 208 is formed in and extends partially down through the drive shaft 26. A rotary connector or coupling 210 connects the stationary conduit 206 with the rotating manifold 208 so as to permit flow of the medium from one to the other with minimal or no leakage.

A pressure source 209, such as compressed air or a blower, is preferably used to channel the medium into the manifold 208. It is also contemplated that a vacuum source (i.e., negative pressure source) could be installed downstream for drawing the medium into the manifold 208.

One or more main ports 212 are formed on the shaft 26 and are in fluid communication with the manifold 208 so as to provide an exit for the medium flowing in the manifold 208. Preferably there is a port 212 for each vessel in the rotational processor, although it is also possible for one port to connect to a gang for supplying the medium to one or more of the processing vessels. A hose 214 connects the port 212 to each vessel 18, preferably again through a rotary coupling 216. A valve 218 (shown in phantom) may be included between the port and the vessel 18 for controlling flow into the vessel. The valve 218 could be controlled by a controller 29, such as a digital or analog computer, or other microprocessor unit. The use and control of multiple valves 218 permits variation of the environment in each vessel 18. Thus, the environment within the vessel 18 can be controlled manually or through a computer program.

Alternatively or in addition to valve 218, a central valve 220 (shown in phantom) may be included between the supply 202 and the manifold 208 for controlling overall supply to the vessels 18. Again, a controller 29 can be used to permit control of the valve 220, either manually, or automatically.

In one exemplary embodiment, the system is designed to supply cooled air to the vessels to cool the products being processed, as well as the media within the vessel. As such, a refrigeration unit 204 is used to cool the air before it is supplied to the manifold 208. However, it is also contemplated that, instead of or in addition to the refrigeration unit, a vortex generator 300 may be installed at the inlet 222 to the vessel 18. Vortex generators are well known devices that generate a cool flow of air through separation of hot air using a flow generated vortex. One suitable vortex generator is sold by Exair Corporation, Cincinnati, Ohio, under the trade name Exair Vortex Tube.

Figure 3:
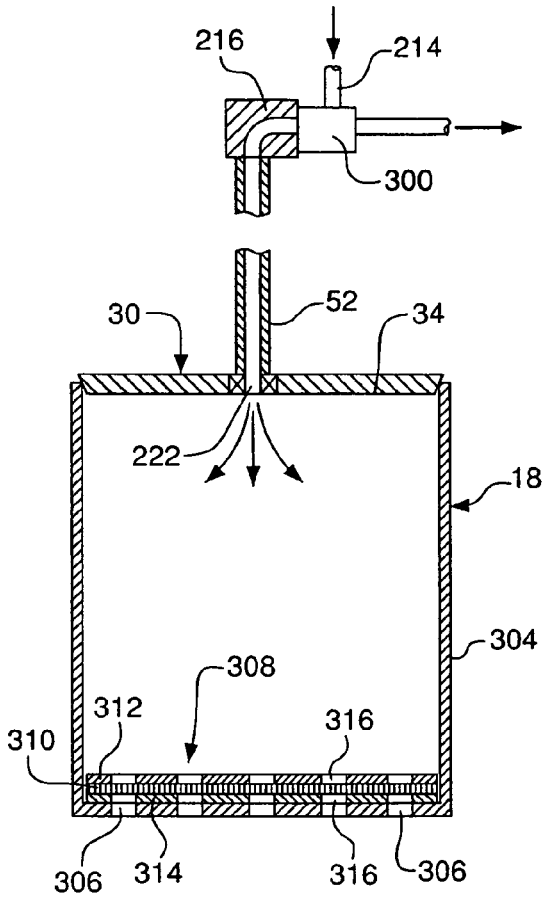
FIG. 3 is a cross-sectional view of a processing vessel showing the connection to the environmental control system according to one embodiment of the invention

Turning now to FIG. 3, a cross-sectional view of one exemplary processing vessel 18 is shown. The vessel 18 includes a lid 30 which is removably attached to the vessel body 304. The removable attachment can be through clamps, bolts or other common fastening systems that are capable for withstanding high centrifugal and rotary loads without opening. An active lid system, such as the one discussed above or the one shown in PCT/IUS03/21218, may be included. PCT/US03/21218 is incorporated herein by reference in its entirety. Preferably the lid system is as shown in FIG. 2.

The vessel 18 preferably includes apertures or vents 306 to permit the flow of air that enters the inlet 222, to eventually pass out of the vessel. In the illustrated embodiment, the apertures 306 are shown in the bottom of the vessel 18 and are arranged as a plurality of spaced apart holes. The holes 306 are preferably arranged in pattern which may be located near the center of the vessel 18. It should also be readily apparent that the vents need not be holes in the base of the vessel 18. On the contrary, the location of the holes can vary depending on many factors, including based on the direction of the air flow. For example, it is contemplated that the vessel can be arranged such that the inlet is located at the bottom or along the sides of the vessel. In this configuration, the system would take advantage of the natural rise of warm air to help circulate the air from the inlet to an outlet. Also, the vent need not be shaped as a hole, but can be a gap between the lid 30 and the vessel body 304. Thus, some degree of permeability of the vessel can act as a vent.

Figure 4:
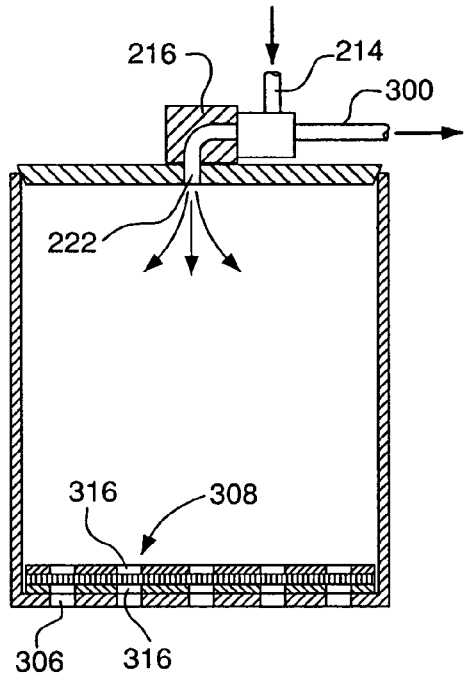
FIG. 4 is a cross-section view of the processing vessel shown in FIG. 3 illustrating an alternate connection to the environmental control system.

FIG. 4 illustrates an alternate arrangement for attaching the hose 214 directly to a vessel lid 30 without a lid system. Again, as in FIG. 3, a vortex generator 300 is shown attached to the lid 30.

Figure 5:
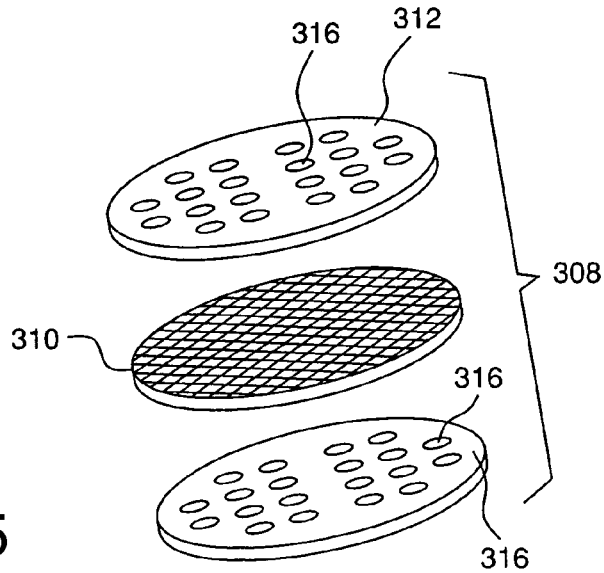
FIG. 5 is an exploded view of one embodiment of a filter assembly for use in the processing vessels.

Referring to FIGS. 3 and 5, in order to inhibit the media from passing through the holes 306, a filter 308 is located inside the vessel 18 on the bottom. In one embodiment, the filter 308 includes a mesh layer 310 that permits passage of the secondary medium that is channeled into the vessel 18, while minimizing the passage of the processing media. The mesh 310 is attached to a filter frame which supports the mesh to minimize its deformation during processing. In one embodiment, the filter frame includes upper and lower frame support plates 312, 314 that have holes 316 formed in them at spaced apart intervals. The holes 316 are preferably arranged in pattern which, as with the holes 306 in the vessel 18 itself, are preferably located near the center of the plates 314. Of course, if a fixture is used to hold the products being processed within the vessel, the fixture and/or the holes 316 are preferably positioned or configured so as to not inhibit air flow to the holes 316. The attachment of the filter frame to the mesh 310 may be through any well known means, such as bonding, welding, fastening, etc.

In many cases, the holes 306 in the vessel 18 can simply exhaust to the atmosphere. However, if the secondary medium that is supplied to the vessel is of a type that should not be exhausted freely to the atmosphere, or if it is desirable to recycle the secondary medium, then the holes may be replaced with one or more exhaust ports (not shown) that are formed in the vessel 18 and which connect with a return manifold to a waste or return reservoir (not shown).

As discussed in U.S. Pat. No. 6,863,207, welding or bonding of many materials can be inhibited by the existence of an oxide layer on one or both materials. For example, an oxide layer on the surface of iron tends to inhibit that material from bonding with copper. Prior art devices (i.e., processes which subject the material to pressure and temperature) achieve welding by stretching the oxide layer (due to thermal expansion), thus creating voids which allow the underlying materials to weld to one another. The present invention can be used to remove the oxide layer by subjecting the parts being processed to abrasive media during centrifugal processing while creating a vacuum within the vessel 18. In this embodiment, a vacuum or negative pressure source would be connected to the manifold 208 so as to exhaust air from inside the vessel 18. By subjecting the articles to both a vacuum and a high force, it is possible to produce welding of materials.

The above described invention provides a unique control system for controlling the environment within a rotating vessel during centrifugal processing. By controlling the environmental, the processing of the surface and subsurface of the product within the vessel can be controlled.

The present invention may be embodied in other specific forms without departing from the spirit or essential attributes thereof and, accordingly, reference should be made to the appended claims, rather than to the foregoing specification, as indicating the scope of the invention.

What is claimed is:

1. A centrifugal processor comprising:

an outer frame having an inner surface and an axis;

at least one inner vessel positioned within the outer frame and adapted to receive a first medium and an object to be processed, the inner vessel having an interior;

a drive system for rotating the inner vessel with respect to the outer frame and along the inner surface of the outer frame, the drive system including a central shaft engaged with the vessel for rotating the vessel about the axis; and an environmental control system for channelling a second medium to or from the vessel to assist in the processing of the object, the environmental control system including a manifold formed in at least a portion of the central shaft and adapted to channel the second medium, at least one port formed in the central shaft and connected to the manifold, and a conduit connected to the port and the inner vessel for channelling the second medium between the manifold and the interior of the vessel, wherein the environmental control system includes a supply which contains the second medium to be channelled into the vessels, and a conduit connecting the supply to the manifold, and wherein the second medium is a cooled gas that is supplied into the vessel to reduce the temperature of the interior of the vessel, and wherein the environmental control system includes a refrigeration unit for cooling the gas.

2. A centrifugal processor according to claim 1, wherein the second medium is supplied to the vessel prior to, during, or after rotation, or combinations thereof.

3. A centrifugal processor comprising:

an outer frame having an inner surface and an axis;

at least one inner vessel positioned within the outer frame and adapted to receive a first medium and an object to be processed, the inner vessel having an interior;

a drive system for rotating the inner vessel with respect to the outer frame and along the inner surface of the outer frame, the drive system including a central shaft engaged with the vessel for rotating the vessel about the axis; and an environmental control system for channelling a second medium to or from the vessel to assist in the processing of the object, the environmental control system including a manifold formed in at least a portion of the central shaft and adapted to channel the second medium, at least one port formed in the central shaft and connected to the manifold, and a conduit connected to the port and the inner vessel for channelling the second medium between the manifold and the interior of the vessel, wherein the environmental control system includes a temperature control unit for either heating or cooling the second medium prior to channelling into the vessel.

4. A centrifugal processor comprising:

an outer frame having an inner surface and an axis;

at least one inner vessel positioned within the outer frame and adapted to receive a first medium and an object to be processed, the inner vessel having an interior;

a drive system for rotating the inner vessel with respect to the outer frame and along the inner surface of the outer frame, the drive system including a central shaft engaged with the vessel for rotating the vessel about the axis; and an environmental control system for channelling a second medium to or from the vessel to assist in the processing of the object, the environmental control system including a manifold formed in at least a portion of the central shaft and adapted to channel the second medium, at least one port formed in the central shaft and connected to the manifold, and a conduit connected to the port and the inner vessel for channelling the second medium between the manifold and the interior of the vessel, wherein the environmental control system includes a vortex generator mounted between the manifold and the vessel for cooling the second medium prior to entry into the vessel, and wherein the conduit connects to the vortex generator.

5. A centrifugal processor comprising:

an outer frame having an inner surface and an axis;

at least one inner vessel positioned within the outer frame and adapted to receive a first medium and an object to be processed, the inner vessel having an interior;

a drive system for rotating the inner vessel with respect to the outer frame and along the inner surface of the outer frame, the drive system including a central shaft engaged with the vessel for rotating the vessel about the axis; and an environmental control system for channelling a second medium to or from the vessel to assist in the processing of the object, the environmental control system including a manifold formed in at least a portion of the central shaft and adapted to channel the second medium, at least one port formed in the central shaft and connected to the manifold, and a conduit connected to the port and the inner vessel for channelling the second medium between the manifold and the interior of the vessel, wherein the environmental control system includes a valve for controlling flow of the second medium into or out of the vessel.

6. A centrifugal processor according to claim 5, wherein a controller controls the operation of the valve.

7. A centrifugal processor comprising:

an outer frame having an inner surface and an axis;

a plurality of inner vessels positioned within the outer frame and adapted to receive an object to be processed, each inner vessel having an interior;

a drive system for rotating the inner vessels with respect to the outer frame and along the inner surface of the outer frame, the drive system including a motor and a central drive shaft, the central drive shaft adapted to be driven by the motor, the shaft adapted to rotate the vessels about the axis; and an environmental control system for channelling an environmental control medium to or from the vessels to assist in the processing of the object, the environmental control system including a manifold with a plurality of output conduits, each conduit connecting the manifold to an inner vessel for channelling the environmental control medium between the manifold and the interior of the vessel;

wherein the environmental control system includes a supply which contains the environmental control medium to be channelled into the vessels, and a conduit connecting the supply to the manifold; and wherein the environmental control medium is a cooled gas that is supplied into the vessel to reduce the temperature of the interior of the vessel, and wherein the environmental control system includes a refrigeration unit for cooling the gas.

8. A centrifugal processor comprising:

an outer frame having an inner surface and an axis;

a plurality of inner vessels positioned within the outer frame and adapted to receive an object to be processed, each inner vessel having an interior;

a drive system for rotating the inner vessels with respect to the outer frame and along the inner surface of the outer frame, the drive system including a motor and a central drive shaft, the central drive shaft adapted to be driven by the motor, the shaft adapted to rotate the vessels about the axis; and an environmental control system for channelling an environmental control medium to or from the vessels to assist in the processing of the object, the environmental control system including a manifold with a plurality of output conduits, each conduit connecting the manifold to an inner vessel for channelling the environmental control medium between the manifold and the interior of the vessel, wherein the environmental control system includes a vortex generator mounted between the manifold and the vessel for cooling the environmental control medium prior to entry into the vessel, and wherein the conduit connects to the vortex generator.

9. A centrifugal processor according to claim 3, wherein the environmental control system includes a vortex generator mounted between the manifold and the vessel for cooling the second medium prior to entry into the vessel, and wherein the conduit connects to the vortex generator.

* * * * *